US009645524B2

(12) United States Patent
Sato

(10) Patent No.: US 9,645,524 B2
(45) Date of Patent: May 9, 2017

(54) PRINT SHEET CREATING APPARATUS AND PRINT SHEET CREATING METHOD

(71) Applicant: CASIO COMPUTER CO., LTD., Shibuya-ku, Tokyo (JP)

(72) Inventor: Masaru Sato, Kodaira (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/061,978

(22) Filed: Mar. 4, 2016

(65) Prior Publication Data

US 2016/0187811 A1 Jun. 30, 2016

Related U.S. Application Data

(63) Continuation of application No. PCT/JP2014/070207, filed on Jul. 31, 2014.

(30) Foreign Application Priority Data

Sep. 19, 2013 (JP) ..... 2013-194652

(51) Int. Cl.

| | |
|---|---|
| ***G03G 15/00*** | (2006.01) |
| ***G03G 15/08*** | (2006.01) |
| ***G03G 15/22*** | (2006.01) |
| ***G03G 21/14*** | (2006.01) |
| ***G03G 15/01*** | (2006.01) |

(52) U.S. Cl.

CPC ..... *G03G 15/0831* (2013.01); *G03G 15/0178* (2013.01); *G03G 15/22* (2013.01);

(Continued)

(58) Field of Classification Search

None

See application file for complete search history.

(56) References Cited

U.S. PATENT DOCUMENTS

2002/0063870 A1* 5/2002 Narasimhan ..... G03G 15/6508 358/1.2

2004/0037574 A1 2/2004 Yamamuro et al.

(Continued)

FOREIGN PATENT DOCUMENTS

JP 02146567 A 6/1990

JP 2004077932 A 3/2004

(Continued)

OTHER PUBLICATIONS

International Search Report (ISR) dated Nov. 4, 2014 issued in International Application No. PCT/JP2014/070207.

(Continued)

*Primary Examiner* — David Gray

*Assistant Examiner* — Thomas Giampaolo, III

(74) *Attorney, Agent, or Firm* — Holtz, Holtz & Volek PC

(57) ABSTRACT

An image forming apparatus includes a unit arranging portion that is provided with a unit containing a powder tank; a determination unit that determines the unit provided in the unit arranging portion; and a control unit that supplies a recording medium from a first sheet feeding portion in a case where the determination unit determines that the unit provided in the unit arranging portion is a unit corresponding to a binder toner, and supplies the recording medium from a second sheet feeding portion different from the first sheet feeding portion in a case where the determination unit determines that the unit provided in the unit arranging portion is a unit corresponding to a toner of a predetermined color.

6 Claims, 7 Drawing Sheets

(52) U.S. Cl.
CPC ..... *G03G 15/6508* (2013.01); *G03G 15/6591* (2013.01); *G03G 21/14* (2013.01); *G03G 15/224* (2013.01); *G03G 2215/00523* (2013.01); *G03G 2215/00801* (2013.01); *G03G 2215/00873* (2013.01)

(56) References Cited

U.S. PATENT DOCUMENTS

| | | | | |
|---|---|---|---|---|
| 2012/0237698 | A1* | 9/2012 | Funahashi ..... | G03G 7/0053 428/32.6 |
| 2013/0078009 | A1 | 3/2013 | Sano et al. | |

FOREIGN PATENT DOCUMENTS

| | | | |
|---|---|---|---|
| JP | 2007155824 | A | 6/2007 |
| JP | 2007286100 | A | 11/2007 |
| JP | 2009160880 | A | 7/2009 |
| JP | 2013068862 | A | 4/2013 |

OTHER PUBLICATIONS

International Preliminary Report on Patentability (IPRP) including Written Opinion (in English) dated Mar. 31, 2016, issued in International Application No. PCT/JP2014/070207.
Japanese Office Action (and English translation thereof) dated May 17, 2016, issued in counterpart Japanese Application No. 2013-194652.

* cited by examiner

PRINT SHEET CREATING APPARATUS AND PRINT SHEET CREATING METHOD

CROSS-REFERENCE TO RELATED APPLICATION

This application is a Continuation Application of PCT Application NO. PCT/JP2014/070207, filed Jul. 31, 2014 and based upon and claiming the benefit of priority from Japanese Patent Application 2013-194652, filed Sep. 19, 2013, the entire contents of all of which are incorporated herein by reference.

BACKGROUND OF THE INVENTION

1. Field of the Invention

The present invention relates to a print sheet creating apparatus and a print sheet creating method.

2. Description of the Related Art

There is known a print sheet having an image formed by transferring toners such as yellow and magenta onto a base sheet. In addition, similarly, there are also known a print sheet creating apparatus and a print sheet creating method which creates the print sheet.

Such a print sheet creating apparatus includes a plurality of image forming units. These image forming units each form images having different colors from each other and stake these images, so that a desired image can be formed.

In Jpn. Pat. Appln. KOKAI Publication No. 2013-068862, besides the print sheet creating apparatus and the print sheet creating method, a print sheet creating apparatus and a print sheet creating method which creates the print sheet formed with a thermal transfer label are also disclosed.

The print sheet having the thermal transfer label is formed by forming a desired image on the base sheet which has separated surfaces, and transferring a thermoplastic resin on the image.

In the thermal transfer print sheet, the surface opposite to the thermal transfer label of the base sheet is thermally pressed in a state where the surface formed with the thermal transfer label abuts on clothes. Therefore, the thermoplastic resin is melt and fused into the fibers of the clothes. Thereafter, the base sheet is removed from the clothes in a state where the thermoplastic resin is cooled and fixed to the clothes, and thus the thermal transfer label is transferred onto the clothes.

In the print sheet creating apparatus and the print sheet creating method described above, the following problems are found out. In other words, the print sheet creating apparatus includes a plurality of unit arranging portions which are capable of disposing the image forming units. An instruction of forming an image to the image forming unit is sent through the unit arranging portion to the image forming unit. In other words, for example, an instruction of forming a yellow image is sent to the unit arranging portion which is disposed in the yellow image forming unit.

In a case where the print sheet creating apparatus is used in a normal printing mode for forming a normal image on the base sheet, and in a case where the thermal transfer label is formed, the image forming units are differently disposed. Therefore, in a case where the apparatus for the normal printing mode is converted for forming the thermal transfer label, for example, the magenta image forming unit for forming the thermal transfer label is disposed in the unit arranging portion in which the yellow image forming unit is disposed for the normal printing mode. In this case, the instruction of forming the yellow image is sent to the magenta image forming unit, and a desired image is not formed. Therefore, the print sheet creating apparatus for forming an image is not possible to form the thermal transfer label. Similarly, the print sheet creating apparatus for forming the thermal transfer label is not possible to form the normal image.

On the other hand, for example, Jpn. Pat. Appln. KOKAI Publication No. 2004-077932 discloses an image forming apparatus which includes a first developing unit to form an image using one or more types of first developers and an attachable second developing unit to form an image using one or more types of second developers different from the first developer. In the disclosed image forming apparatus, there are provided a developing-unit determining unit which determines the type of the developing unit provided in the image forming apparatus and an informing unit which informs a user of an error indicating the reason why an image forming command is not accepted in a case where the user inputs the image forming command to form an image containing the second developer when the second developing unit is not mounted. However, the image forming apparatus is an apparatus which forms an image in an image bearing member and thus the creating of the thermal transfer label is not possible, and the creating of the thermal transfer label is neither described nor suggested.

Furthermore, for example, Jpn. Pat. Appln. KOKAI Publication No. 2007-155824 discloses a tandem type of an image forming apparatus which includes a plurality of image forming units, and forms a color image by transferring toner images of colors created by the respective image forming units on a transfer body in a multiplex manner. The image forming apparatus includes four or more storage portions for storing the image forming units, and execute an image forming mode of forming the color image by using only the first to the third image forming units as the plurality of image forming units in a case where a first image forming unit for magenta is stored in a first storage portion, a second image forming unit for cyan is stored in a second storage portion, and a third image forming unit for black is stored in a third storage portion. However, the image forming apparatus is an apparatus which forms an image in an image bearing member and thus the creating of the thermal transfer label is not possible, and the creating of the thermal transfer label is neither described nor suggested.

Furthermore, for example, Jpn. Pat. Appln. KOKAI Publication No. 02-146567 discloses an image forming apparatus which is mounted with any of a plurality of cartridges having a single developer or a plurality of developer groups and forms a recording image according to an input image data. The image forming apparatus includes an identification unit which identifies the type of the mounted cartridge, a display unit which displays an operating mode according to the identified result, a mode setting unit which sets a mode to operate the apparatus, and a control unit which operates the apparatus in a mode set by the mode setting unit. However, the image forming apparatus is an apparatus which forms an image in an image bearing member and thus the creating of the thermal transfer label is not possible, and the creating of the thermal transfer label is neither described nor suggested.

The invention has been made in view of the above problems, and an object thereof is to provide a print sheet creating apparatus and a print sheet creating method which is capable of performing both the thermal transfer label forming and the normal printing.

BRIEF SUMMARY OF THE INVENTION

In order to solve the problems and achieve the object, the print sheet creating apparatus and the print sheet creating method according to the invention are configured as follows.

The image forming apparatus includes a unit arranging portion that is provided with a unit containing a powder tank; a determination unit that determines the unit provided in the unit arranging portion; and a control unit that supplies a recording medium from a first sheet feeding portion in a case where the determination unit determines that the unit provided in the unit arranging portion is a unit corresponding to a binder toner, and supplies the recording medium from a second sheet feeding portion different from the first sheet feeding portion in a case where the determination unit determines that the unit provided in the unit arranging portion is a unit corresponding to a toner of a predetermined color.

The image forming apparatus includes a plurality of unit arranging portions, each of which is provided with a unit containing a powder tank; a determination unit that determines a combination of the units provided in the plurality of unit arranging portions; and a control unit that switches a sheet feeding portion according to the combination of the units determined by the determination unit, the sheet feeding portion being supplied with a recording medium.

In addition, in a thermal transfer print sheet creating method according to the invention configured as descried above, the print sheet creating method includes determining a unit provided in a unit arranging portion in which a unit containing a powder tank is provided; and supplying a recording medium from a first sheet feeding portion in a case where it is determined in the determining that the unit provided in the unit arranging portion is a unit corresponding to a binder toner, and supplying the recording medium from a second sheet feeding portion different from the first sheet feeding portion in a case where it is determined in the determining that the unit provided in the unit arranging portion is a unit corresponding to a toner of a predetermined color.

According to the invention, it is possible to perform both the thermal transfer label forming and the normal printing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
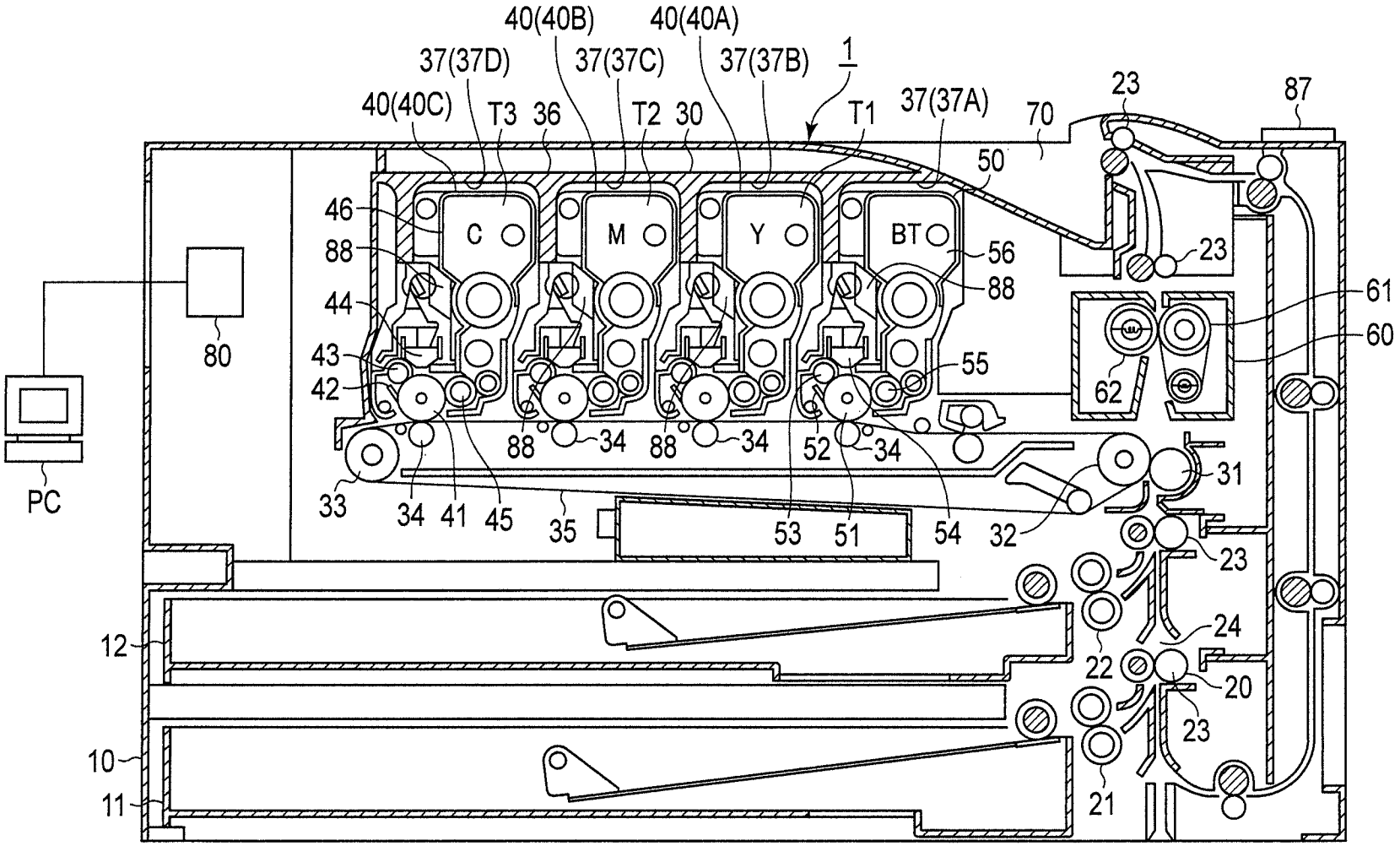
FIG. 1 is a vertical cross-sectional view illustrating an inner structure of a print sheet creating apparatus according to an embodiment of the invention.
Figure 2:
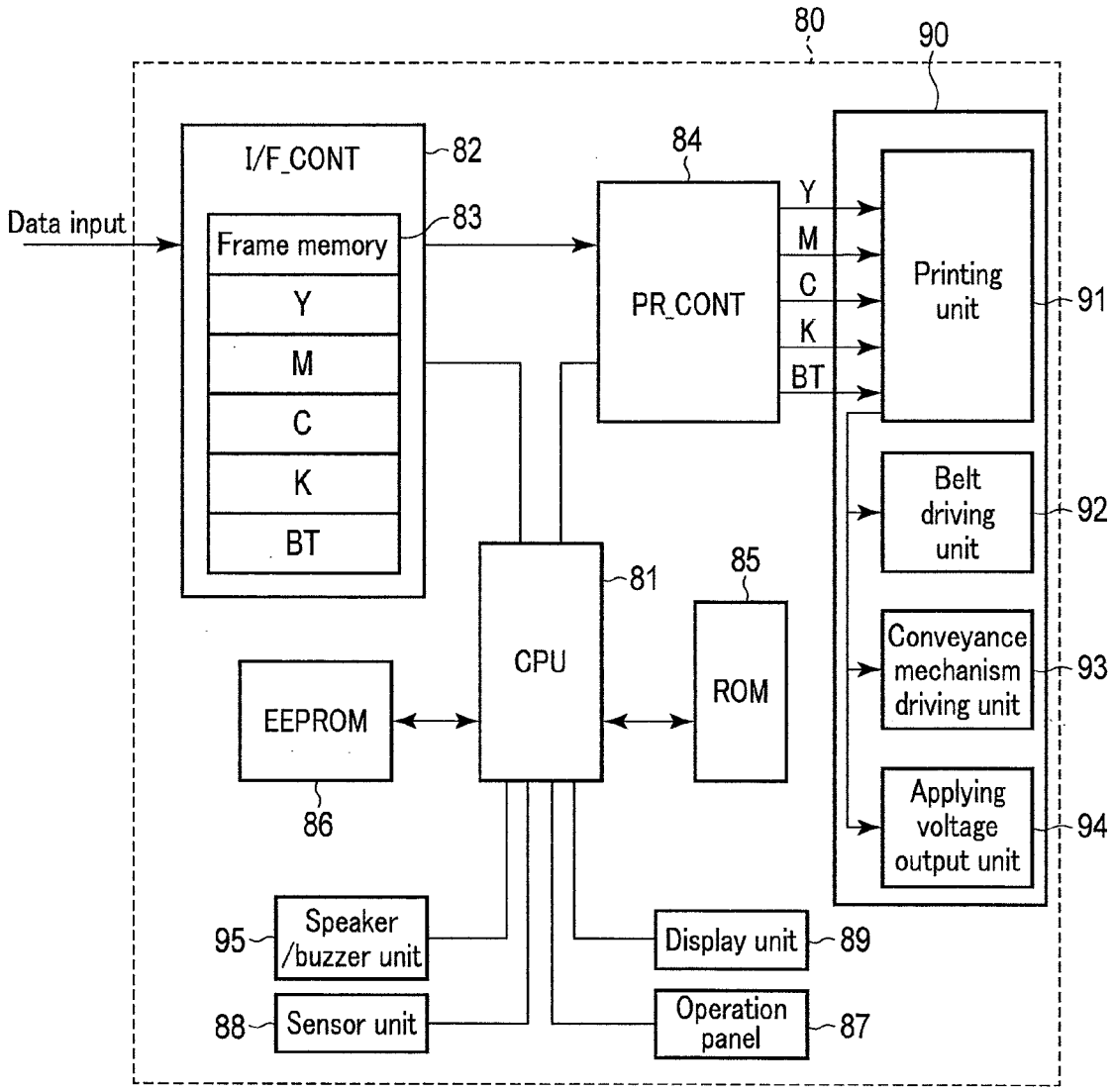
FIG. 2 is a diagram for describing a control unit of the print sheet creating apparatus.
Figure 3:
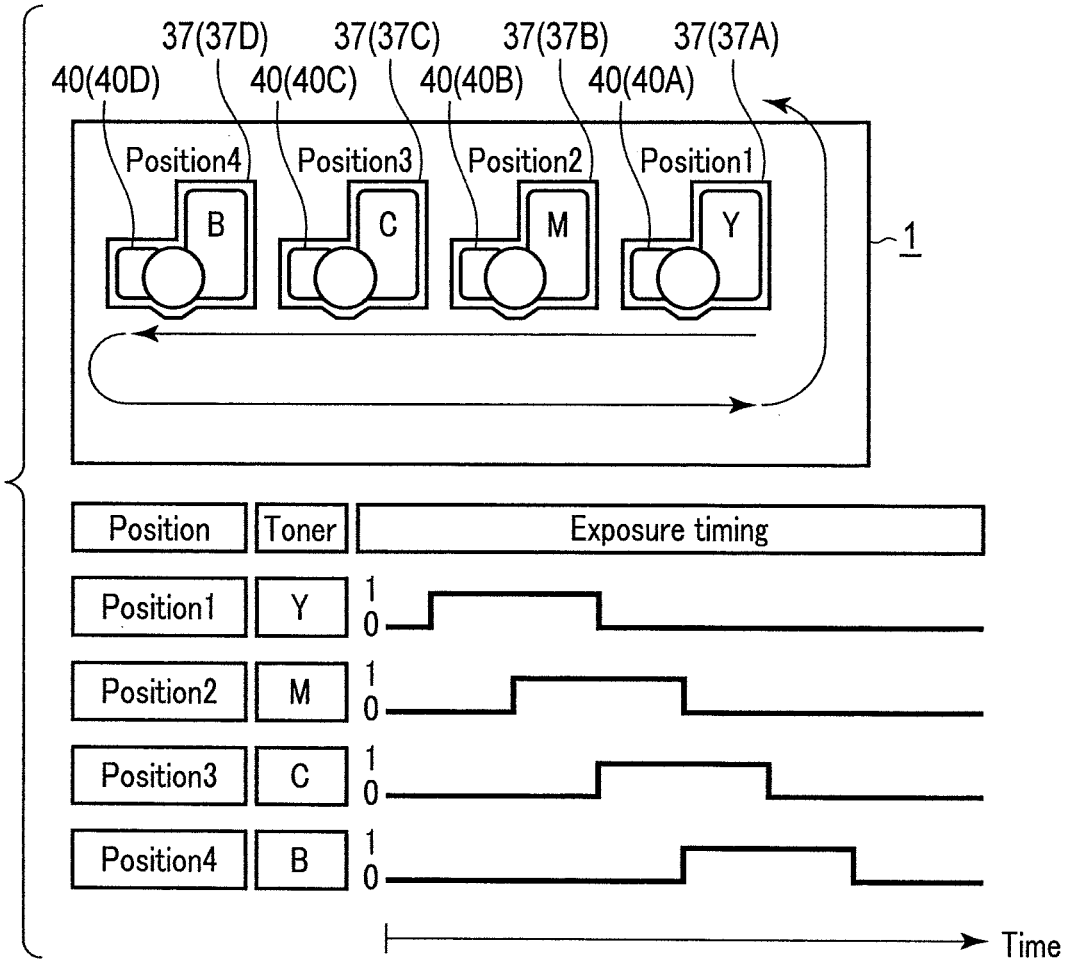
FIG. 3 is a diagram for describing an image exposure timing in a normal print mode of the print sheet creating apparatus.
Figure 4:
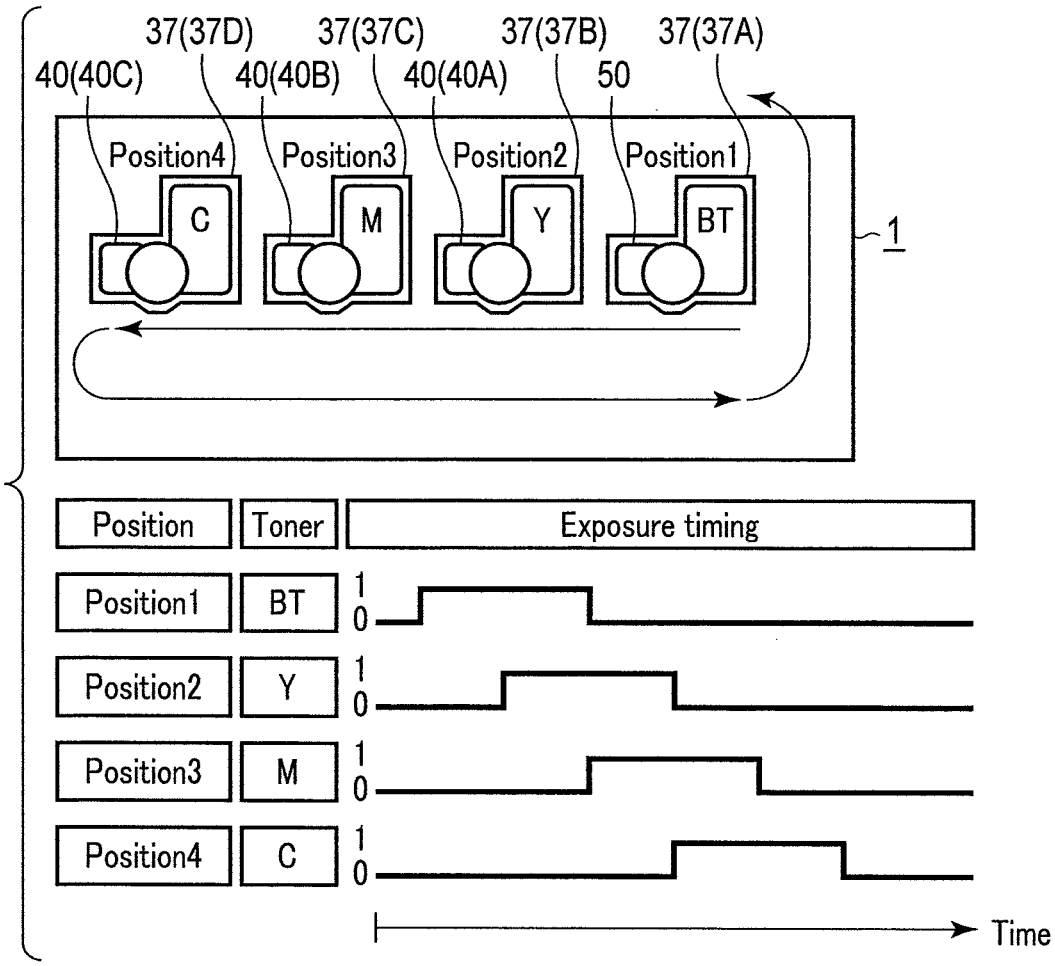
FIG. 4 is a diagram for describing an image exposure timing in a label creating mode of the print sheet creating apparatus.
Figure 5A:
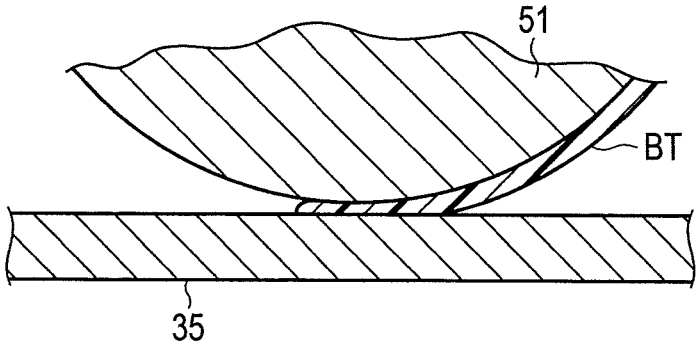
FIG. 5A is a cross-sectional view illustrating an intermediate transfer procedure in the label creating mode of the print sheet creating apparatus.
Figure 5B:
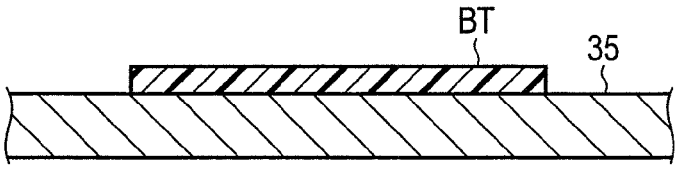
FIG. 5B is a cross-sectional view illustrating the intermediate transfer procedure in the label creating mode of the print sheet creating apparatus.
Figure 5C:
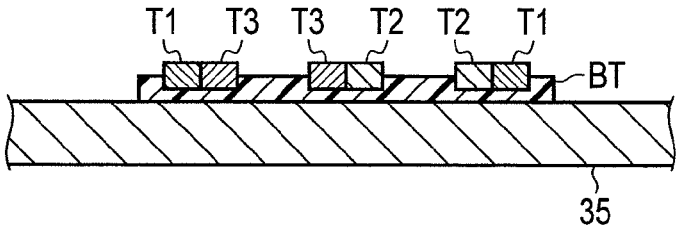
FIG. 5C is a cross-sectional view illustrating the intermediate transfer procedure in the label creating mode of the print sheet creating apparatus.
Figure 6:
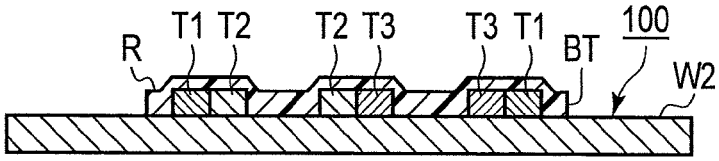
FIG. 6 is a cross-sectional view illustrating a print sheet which is created by the print sheet creating apparatus.

FIG. 1 is a vertical cross-sectional view illustrating an inner structure of a print sheet creating apparatus 1 according to an embodiment of the invention, FIG. 2 is a diagram for describing a control unit 80 of the print sheet creating apparatus 1, FIG. 3 is a diagram for describing an image exposure timing in a normal print mode of the print sheet creating apparatus 1, FIG. 4 is a diagram for describing an image exposure timing in a thermal transfer label forming mode of the print sheet creating apparatus 1, FIGS. 5A to 5C are cross-sectional views illustrating an intermediate transfer procedure in a label creating mode of the print sheet creating apparatus 1, FIG. 6 is a cross-sectional view illustrating a print sheet 100 which is created by the print sheet creating apparatus 1, and FIGS. 7A to 7D are cross-sectional views illustrating a thermal transfer procedure of the print sheet 100.

The print sheet creating apparatus 1 includes, as illustrated in FIG. 1, a base sheet feeding portion 10 which feeds a first base sheet W1 and a second base sheet W2, a conveyance mechanism 20 which conveys the first base sheet W1 and the second base sheet W2, an intermediate transfer portion 30 which is disposed in the conveyance mechanism 20 and transfers a toner to the first base sheet W1 and the second base sheet W2, a fixing device 60 which fixes the toner to the first base sheet W1 and the second base sheet W2, a sheet discharge portion 70 to which the first base sheet W1 and the second base sheet W2 are discharged, and the control unit 80 which controls processes from the feeding to the discharging of the first base sheet W1 and the second base sheet W2. Further, the print sheet creating apparatus 1 includes two modes of a normal print mode α and a thermal transfer label creating mode β which will be described below. FIG. 1 illustrates the print sheet creating apparatus 1 of the thermal transfer label creating mode β.

The base sheet feeding portion 10 includes a first sheet feeding portion 11 which feeds the first base sheet W1 used in the normal print mode α and a second sheet feeding portion 12 which feeds the second base sheet W2 used in the thermal transfer label creating mode β.

The conveyance mechanism 20 includes a first sheet feeding roller 21 to which the first base sheet W1 is fed from the first sheet feeding portion 11, a second sheet feeding roller 22 to which the second base sheet W2 is fed from the second sheet feeding portion 12, and a plurality of conveyance rollers 23 which are provided in places from the first sheet feeding roller 21 and the second sheet feeding roller 22 to the sheet discharge portion 70. In the conveyance mechanism 20, a conveyance path 24 of the first base sheet W1 and the second base sheet W2 is formed from the first sheet feeding portion 11 and the second sheet feeding portion 12 to the sheet discharge portion 70. The plurality of conveyance roller 23 is disposed along the conveyance path 24.

The intermediate transfer portion 30 includes a transfer roller (a transfer portion) 31, a first drive roller 32, a second drive roller 33, a plurality of intermediate transfer rollers 34, a transfer belt 35 which is suspended on the first drive roller 32, the second drive roller 33, and the intermediate transfer roller 34, and an image forming portion 36 which is provided along the transfer belt 35.

The transfer roller 31 is provided at a position facing the first drive roller 32 with the transfer belt 35 interposed therebetween. In addition, the conveyance path 24 is positioned between the transfer roller 31 and the first drive roller 32.

The second drive roller 33 is disposed on an opposite side of the first drive roller 32 with respect to the transfer roller 31. In addition, the intermediate transfer roller 34 is disposed at a position facing the image forming portion 36 with the transfer belt 35 interposed therebetween.

The image forming portion 36 includes four unit arranging portions 37 which are provided along the transfer belt 35. In the unit arranging portion 37, any one of an image forming unit 40 described below and a binder toner transfer unit (a label base material forming unit) 50 described below can be disposed. Further, the binder toner is an example of the label base material. In addition, in the following description, the four unit arranging portions 37 will be referred to as a first unit arranging portion 37A, a second unit arranging portion 37B, a third unit arranging portion 37C, and a fourth unit arranging portion 37D in this order from the first drive roller 32 which abuts on the conveyance path of the conveyance mechanism 20 along a moving direction of the transfer belt 35.

The image forming unit 40 includes a photosensitive drum. 41, a cleaner 42 which is disposed enclosing the photosensitive drum 41 in a circumferential direction of a peripheral surface thereof, a charging roller 43, an exposure head 44, a developing roller 45, and a powder tank 46 which supplies power of a first resin powder toner T1 etc. described below to the developing roller 45.

The photosensitive drum 41 is positioned on a side near the upper surface of the transfer belt 35 in a state where the image forming unit 40 is disposed in the unit arranging portion 37, and rotates in a direction sending the transfer belt 35 toward the second drive roller 33 (the counterclockwise direction in FIG. 1). The photoconductor on the surface of the photosensitive drum 41 is charged by the charging roller 43. Thereafter, the surface of the charging roller 43 is projected with the light by the exposure head 44, and a charged portion and a non-charged portion are defined. The powder is supplied from the powder tank 46 while being stirred by the rotation of the developing roller 45 and attached to the surface of the developing roller 45. The powder charged with static electricity after being stirred is attached to the non-charged portion on the photosensitive drum 41 from the developing roller 45. Thereafter, the transfer belt 35 is pressed by the photosensitive drum 41 and the intermediate transfer roller 34, and the powder is transferred onto the transfer belt 35. After the transfer, the extra powder is removed by the cleaner 42 and fallen from the surface of the photosensitive drum 41. The image forming unit 40 transfers the powder onto the transfer belt 35 by repeatedly performing the procedure from the charging until the extra powder is fallen.

Further, in the following description, the image forming unit 40 is referred to as a first image forming unit 40A, a second image forming unit 40B, a third image forming unit 40C, and a fourth image forming unit 40D according to the color of the powder in the powder tank 46. The first image forming unit 40A, the second image forming unit 40B, the third image forming unit 40C, and the fourth image forming unit 40D respectively have a function of transferring the first resin powder toner T1 of yellow Y, a second resin powder toner T2 of magenta M, a third resin powder toner T3 of cyan C, and a fourth resin powder toner T4 of black K onto the transfer belt 35.

The binder toner transfer unit 50 includes a photosensitive drum 51, a cleaner 52 which is disposed enclosing the peripheral surface of the photosensitive drum 51, a charging roller 53, an exposure head 54, a developing roller 55, and a powder tank 56 which supplies a binder toner BT to the developing roller 55.

The photosensitive drum 51 is positioned on a side near the upper surface of the transfer belt 35 in a state where the binder toner transfer unit 50 is disposed in the unit arranging portion 37, and rotates in a direction sending the transfer belt 35 toward the second drive roller (the clockwise direction in FIG. 1). The photoconductor on the surface of the photosensitive drum 51 is charged by the charging roller 53. Thereafter, the surface of the charging roller 53 is projected with the light by the exposure head 54, and the charged portion and the non-charged portion are defined. The powder is supplied from the powder tank 56 while being stirred by the rotation of the developing roller 55 and attached to the surface of the developing roller 45. The powder charged with static electricity after being stirred is attached to the non-charged portion on the photosensitive drum 51 from the developing roller 55. Thereafter, the transfer belt 35 is pressed by the photosensitive drum 51 and the intermediate transfer roller 34, and the powder is transferred onto the transfer belt 35. After the transfer, the extra powder is removed by the cleaner 52 and fallen from the surface of the photosensitive drum 51. The binder toner transfer unit 50 transfers the powder onto the transfer belt 35 by repeatedly performing the procedure from the charging until the extra powder is fallen.

In other words, the binder toner transfer unit 50 has the same structure as that of the image forming unit 40.

The fixing device 60 is provided on a downstream side the intermediate transfer portion 30, and includes a pair of fixing rollers 61 and 62. The fixing device 60 has a function of fixing the binder toner BT and the first resin powder toner T1, the second resin powder toner T2, the third resin powder toner T3, and the fourth resin powder toner T4 to the first base sheet W1 and the second base sheet W2.

The first base sheet W1 and the second base sheet W2 are discharged to the sheet discharge portion 70 which is provided on the downstream side of the fixing device 60.

As illustrated in FIG. 2, the control unit 80 includes a central processing unit (CPU) (a determination unit) 81, an interface controller (I/F_CONT) 82 which is connected to the CPU 81 through a data path, a printer controller (PR_CONT) 84, and an instruction unit 90 which is connected to the printer controller 84.

The CPU 81 further includes a read only memory (ROM) 85, an electrically erasable programmable ROM (EEPROM) 86, an operation panel 87 of a main operation unit, a sensor unit (a detection unit) 88, a display unit 89, and a speaker/buzzer unit 95.

A system program is stored in the ROM 85, and the CPU 81 has a function of performing processes by controlling the respect units according to the program.

The sensor unit 88 is connected to the first unit arranging portion 37A, the second unit arranging portion 37B, the third unit arranging portion 37C, and the fourth unit arranging portion 37D, and has a function of detecting whether the first image forming unit 40A, the second image forming unit 40B, the third image forming unit 40C, the fourth image forming unit 40D, or the binder toner transfer unit 50 is disposed in the unit arranging portions 37.

The interface controller 82 is connected to a host apparatus (a host PC) PC such as a personal computer directly or through a network. The connection with the interface controller 82 is configured by a direct connection with the host apparatus by a USB cable etc. or by a connection through a network where a plurality of host PCs is directly or indirectly connected. The interface controller 82 includes a frame memory 83 in which print data supplied from the host apparatus PC is developed. In the frame memory 83, a plurality of memory areas are set and data of the toner of yellow Y, magenta M, cyan C, and black K (the first resin powder toner T1, the second resin powder toner T2, the third resin powder toner T3, and the fourth resin powder toner T4) and the binder toner (BT) can be stored in the respective memory areas.

The printer controller 84 is connected to the interface controller 82 and the instruction unit 90. The printer controller 84 has a function of outputting the data developed in the interface controller 82 to the instruction unit 90.

The instruction unit 90 includes a printing unit 91, a belt driving unit 92, a conveyance mechanism driving unit 93, and an applying voltage output unit 94. The instruction unit 90 has a function of controlling the respective units based on the control of the printer controller 84.

The printing unit 91 has a function of controlling the image forming unit 40 and the binder toner transfer unit 50 which are disposed in the respective unit arranging portions 37 illustrated in FIG. 1 based on the control of the printer controller 84. The belt driving unit 92 has a function of controlling the driving of the first drive roller 32 and the second drive roller 33. The conveyance mechanism driving unit 93 has a function of controlling the conveyance mechanism 20. The applying voltage output unit 94 has a function of controlling the fixing device 60.

The above-described print sheet creating apparatus 1 includes two modes of the normal print mode α and the thermal transfer label creating mode β.

In the normal print mode α, as illustrated in FIG. 3, the first image forming unit 40A, the second image forming unit 40B, the third image forming unit 40C, and the fourth image forming unit 40D are respectively disposed in the first unit arranging portion 37A, the second unit arranging portion 37B, the third unit arranging portion 37C, and the fourth unit arranging portion 37D (a first combination). In other words, the first resin powder toner T1 of yellow, the second resin powder toner T2 of magenta, the third resin powder toner T3 of cyan, and the fourth resin powder toner T4 of black are sequentially transferred onto the transfer belt 35.

In the thermal transfer label creating mode β, as illustrated in FIG. 4, the binder toner transfer unit 50, the first image forming unit 40A, the second image forming unit 40B, and the third image forming unit 40C are disposed in the first unit arranging portion 37A, the second unit arranging portion 37B, the third unit arranging portion 37C, and the fourth unit arranging portion 37D (a second combination). In other words, the transferring is performed in order of the binder toner BT, the first resin powder toner T1, the second resin powder toner T2, and the third resin powder toner T3. Further, in the thermal transfer label creating mode β, the color of black K is expressed by stacking the toners of three colors yellow Y, magenta M, and cyan C. Since yellow Y, magenta M, and cyan C are primary colors, black K can be expressed by stacking three colors.

The normal print mode α and the thermal transfer label creating mode β are modes in which a full color image is formed using the first resin powder toner T1 of yellow, the second resin powder toner T2 of magenta, and the third resin powder toner T3 of cyan.

Further, in a case where a combination of each unit arranging portion 37, each image forming unit 40, and the binder toner transfer unit 50 is different from any one the normal print mode α and the thermal transfer label creating mode β (a third combination), the printing impossible is output to at least one of the display unit 89, the speaker/buzzer unit 95, and the host apparatus PC.

The above-described print sheet creating apparatus 1 forms the print sheet using a method described below. Further, the following description will be made about a case in which a thermal transfer label R is formed on the second base sheet W2.

When an instruction of forming the thermal transfer label R is issued to the host apparatus PC, image data of the thermal transfer label R is input to the interface controller 82 by the host apparatus PC.

The image data is developed into each image data of yellow Y, magenta M, cyan C, black K, and the binder toner BT by the frame memory 83. The image data of the respective colors and the binder toner BT is sent to the CPU 81 and the printer controller 84.

When the image data is sent to the CPU 81, the CPU determines whether a combination of the unit arranging portion 37 and the image forming unit 40 and the binder toner transfer unit 50 acquired by the sensor unit 88 is the same as that of the thermal transfer label creating mode β.

In a case where the combination of the unit arranging portion 37 and the image forming unit 40 and the binder toner transfer unit 50 acquired from the sensor unit 88 is different from that of the thermal transfer label creating mode β, an error is displayed in the host apparatus PC or the display unit 89. In a case where the combination of the unit arranging portion 37 and the image forming unit 40 and the binder toner transfer unit 50 acquired from the sensor unit 88 is the same as that of the thermal transfer label creating mode β, an instruction of creating the print sheet is sent from the CPU 81 to the printer controller 84, and further sent from the printer controller 84 to the instruction unit 90.

The instruction unit 90 issues an instruction to the conveyance mechanism 20, the intermediate transfer portion 30 and the fixing device 60.

When the conveyance mechanism driving unit 93 issues the instruction to the second sheet feeding roller 22, the conveyance of the second base sheet W2 is started.

The belt driving unit 92 issues an instruction to the first drive roller 32 and the second drive roller 33, and the printing unit 91 issues an instruction to the image forming unit 40 and the binder toner transfer unit 50, so that the exposure is started at timing illustrated in FIG. 4.

Further, the image data of the binder toner BT, the image data of yellow Y and black K, the image data of magenta M and black K, and the image data of cyan C and black K are respectively sent from the printer controller 84 to the first unit arranging portion 37A, the second unit arranging portion 37B, the third unit arranging portion 37C, and the fourth unit arranging portion 37D, and then sent to the image forming unit 40 and the binder toner transfer unit 50 disposed in each unit arranging portion 37.

On the transfer belt 35, the binder toner BT, the first resin powder toner T1, the second resin powder toner T2, and the third resin powder toner T3 are transferred at the image exposure timing illustrated in FIG. 4 based on the image data sent to the binder toner transfer unit 50, the first image forming unit 40A, the second image forming unit 40B, and the third image forming unit 40C.

In other words, as illustrated in FIGS. 5A and 5B, the binder toner BT is transferred onto the transfer belt 35 at the exposure timing instructed to the binder toner transfer unit 50.

Thereafter, as illustrated in FIG. 5C, the first resin powder toner T1, the second resin powder toner T2, and the third resin powder toner T3 are transferred onto the binder toner ST at the exposure timing illustrated in FIG. 4.

Figure 5D:
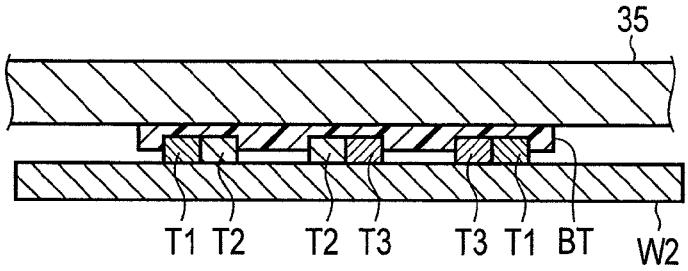
FIG. 5D is a cross-sectional view illustrating the intermediate transfer procedure in the label creating mode of the print sheet creating apparatus.

The binder toner BT, the first resin powder toner T1, the second resin powder toner T2, and the third resin powder toner T3 on the transfer belt 35 are fed between the first drive roller 32 and the transfer roller 31. Further, the second base sheet W2 is conveyed between the first drive roller 32 and the transfer roller 31 by the instruction of the instruction unit 90 at the timing when the binder toner BT and the respective color toners are fed between the first drive roller 32 and the transfer roller 31. Then, as illustrated in FIG. 5D, the binder toner BT and the respective color toners are transferred onto the second base sheet W2.

Thereafter, the binder toner BT and the respective color toners are transferred onto the second base sheet W2 by the fixing device 60, and as illustrated in FIG. 6, the print sheet 100 having the thermal transfer label R is formed.

As illustrated in FIGS. 7A to 7D, the thermal transfer label R is transferred onto a cloth body S such as dresses.

Figure 7A:
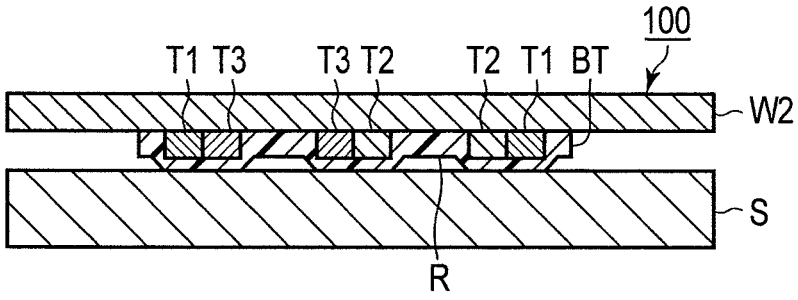
FIG. 7A is a cross-sectional view illustrating a thermal transfer procedure of the print sheet.
Figure 7B:
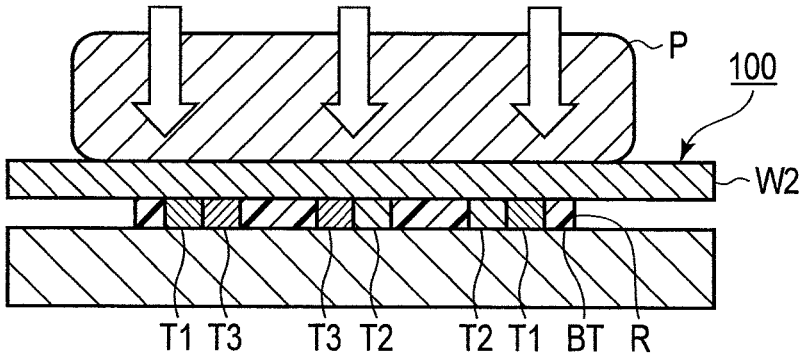
FIG. 7B is a cross-sectional view illustrating the thermal transfer procedure of the print sheet.
Figure 7C:
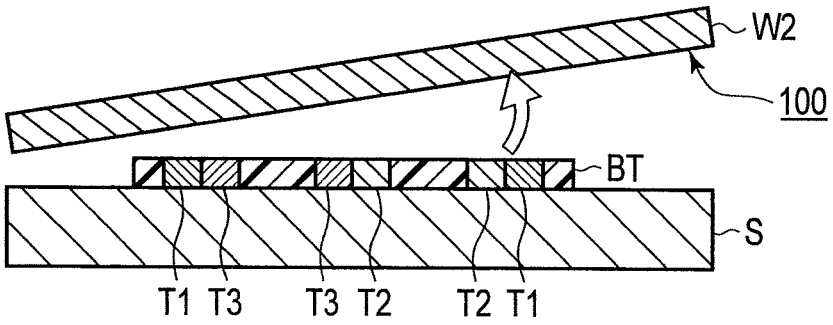
FIG. 7C is a cross-sectional view illustrating the thermal transfer procedure of the print sheet.
Figure 7D:
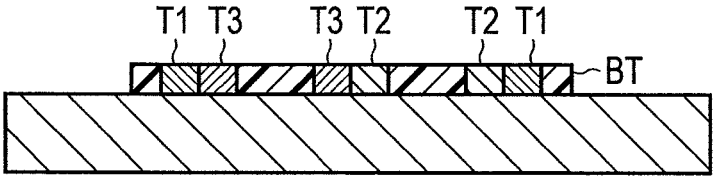
FIG. 7D is a cross-sectional view illustrating the thermal transfer procedure of the print sheet.

In other words, as illustrated in FIG. 7A, the print sheet 100 is disposed on the cloth body S in a state where the thermal transfer label R abuts on the cloth body S. Thereafter, as illustrated in FIG. 7B, the print sheet 100 is thermally compressed by an iron P etc. At this time, the binder toner BT is melted, and fused into the fibers of the cloth body S. Thereafter, the iron P is removed and the print sheet 100 is cooled down. In a state where the print sheet 100 is sufficiently cooled down, as illustrated in FIG. 7C, the second base sheet W2 is removed. The binder toner BT is fixed to the cloth body S by the procedure from the thermal compression to the cooling. Therefore, as illustrated in FIG. 7D, the transfer procedure of the thermal transfer label R is completed.

Further, in the normal print mode α, as described above, the first image forming unit 40A, the second image forming unit 40B, the third image forming unit 40C, and the fourth image forming unit 40D are respectively disposed in the first unit arranging portion 37A, the second unit arranging portion 37B, the third unit arranging portion 37C, and the fourth unit arranging portion 37D. Therefore, when the CPU 81 determines that the first image forming unit 40A, the second image forming unit 40B, the third image forming unit 40C, and the fourth image forming unit 40D are respectively disposed in the first unit arranging portion 37A, the second unit arranging portion 37B, the third unit arranging portion 37C, and the fourth unit arranging portion 37D, the image data of yellow Y, the image data of magenta M, the image data of cyan C, and the image data of black K are respectively sent to the first unit arranging portion 37A, the second unit arranging portion 37B, the third unit arranging portion 37C, and the fourth unit arranging portion 37D by the printing unit of the printer controller 84.

As described above, the formed print sheet creating apparatus 1 is configured such that the CPU 81 determines whether the combination of each unit arranging portion 37 and the image forming unit 40 and the binder toner transfer unit 50 detected by the sensor unit 88 is a combination which is capable of the forming image data sent from the host apparatus PC. Furthermore, the print sheet creating apparatus 1 is configured such that a predetermined image data is sent to the unit arranging portions 37 with the corresponding image forming units 40 and the binder toner transfer unit 50 disposed therein by the printer controller 84 and the printing unit 91. With this configuration, even in a case where the combination of each unit arranging portion 37 and the image forming unit 40 and the binder toner transfer unit 50 is changed, a desired print sheet can be formed. Therefore, the normal printing and the thermal transfer label printing both can be performed.

Furthermore, since the CPU 81 determines whether the combination of each unit arranging portion 37 and the image forming unit 40 and the binder toner transfer unit 50 is any one of the normal print mode α and the thermal transfer label creating mode β, it is possible to prevent a false printing caused by an arrangement error of the image forming unit 40 and the binder toner transfer unit 50 into each unit arranging portion 37. Further, the print sheet creating apparatus may be configured to stop its operation while informing the error using the host PC and the speaker/buzzer unit 95 and the display unit 89 in a case where an error is detected.

In addition, the intermediate transfer scheme may be applied by using the intermediate transfer roller 34 and the transfer belt 35.

As described above, with the print sheet creating apparatus and the print sheet creating method according to the invention, it is possible to perform both the thermal transfer label creating and the normal printing.

Further, the invention is not limited to the above embodiment. For example, the description in the above example has been made about a case where the normal print mode and the thermal transfer label creating mode are provided, but other modes may be provided. In addition, in the above example, the toners of yellow, magenta, and cyan are sequentially transferred onto the transfer belt, but the transfer may be performed in a different order. In this case, a plurality of combinations such as an order of magenta, yellow, and cyan, and an order of cyan, magenta and yellow may be considered.

In addition, the transfer may be performed using an image forming unit of a special color obtained by being specially mixed with red which is widely used in a point of purchase (POP) advertise field. In this case, a plurality of combinations such as a case where the specific color is used instead of magenta and a case where the specific color is transferred between the transfer of magenta and the transfer of yellow may be considered.

Furthermore, in the above example, only one type of the binder toner transfer unit is used in the label creating mode, but two or more types of the binder toner transfer units may be used. In addition, these binder toners may be colored.

In the above embodiment, the description has been made about the apparatus of the intermediate transfer scheme, but it is a matter of course that the invention is similarly applied to an apparatus of a direct transfer scheme. Furthermore, the type of printing medium in the sheet feeding portion is not fixed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a unit arranging portion that is provided with a unit containing a powder tank;

a determination unit that determines the unit provided in the unit arranging portion; and a control unit that supplies a recording medium from a first sheet feeding portion in a case where the determination unit determines that the unit provided in the unit arranging portion is a unit corresponding to a binder toner, and supplies the recording medium from a second sheet feeding portion different from the first sheet feeding portion in a case where the determination unit determines that the unit provided in the unit arranging portion is a unit corresponding to a toner of a predetermined color.

2. The image forming apparatus according to claim 1, further comprising:

an informing unit that informs an error in a case where the determination unit determines that the unit provided in the unit arranging portion is different from the unit corresponding to the binder toner and different from the unit corresponding to the toner of the predetermined color.

3. An image forming apparatus comprising:

a plurality of unit arranging portions, each of which is provided with a unit containing a powder tank;

a determination unit that determines a combination of the units provided in the plurality of unit arranging portions; and a control unit that switches a sheet feeding portion according to the combination of the units determined by the determination unit, the sheet feeding portion being supplied with a recording medium;

wherein the control unit selects a first sheet feeding portion in a case where a unit corresponding to a binder toner is included in the combination of the units determined by the determination unit, and selects a second sheet feeding portion different from the first sheet feeding portion in a case where the unit corresponding to the binder toner is not included in the combination of the units determined by the determination unit.

4. The image forming apparatus according to claim 3, further comprising:

an informing unit that informs an error in a case where the combination of the units determined by the determination unit is not a predetermined combination.

5. A print sheet creating method comprising:

determining a unit provided in a unit arranging portion in which a unit containing a powder tank is provided; and supplying a recording medium from a first sheet feeding portion in a case where it is determined in the determining that the unit provided in the unit arranging portion is a unit corresponding to a binder toner, and supplying the recording medium from a second sheet feeding portion different from the first sheet feeding portion in a case where it is determined in the determining that the unit provided in the unit arranging portion is a unit corresponding to a toner of a predetermined color.

6. The print sheet creating method according to claim 5, further comprising:

informing an error in a case where it is determined in the determining that the unit provided in the unit arranging portion is different from the unit corresponding to the binder toner and different from the unit corresponding to the toner of the predetermined color.

* * * * *